US005205215A

United States Patent [19]

Witczak

[11] Patent Number: 5,205,215

[45] Date of Patent: Apr. 27, 1993

[54] OSCILLATING ROLLER MECHANISM FOR PRINTING OR DUPLICATING MACHINES

[75] Inventor: Stanley Witczak, Chicago, Ill.

[73] Assignee: A.M. International, Inc., Chicago, Ill.

[21] Appl. No.: 672,578

[22] Filed: Mar. 20, 1991

[51] Int. Cl.[5] ..... B41F 31/14

[52] U.S. Cl. ..... 101/348; 101/DIG. 38

[58] Field of Search ..... 101/348, 349, 350, 351, 101/352, 354, 355, 356, 357, 358, 360, 361, 205-209, DIG. 38; 29/116.1; 400/323, 328, 141.1, 169; 74/58

[56] References Cited

U.S. PATENT DOCUMENTS

| | | | |
|---|---|---|---|
| 717,138 | 12/1902 | Thomson | 101/DIG. 38 |
| 892,700 | 7/1908 | Wilson | 101/DIG. 38 |
| 1,421,163 | 6/1922 | Burrows | 74/58 |
| 1,722,535 | 7/1929 | Oishei | 74/58 |
| 3,406,625 | 10/1968 | Chamness et al. | 400/328 |
| 3,628,645 | 12/1971 | McFeaters et al. | 400/328 |
| 4,509,379 | 4/1985 | Westmoreland | 74/58 |
| 4,509,426 | 4/1985 | Hardin | 101/348 |
| 4,756,249 | 7/1988 | Hardin | 101/348 |
| 4,833,987 | 5/1989 | Hardin | 101/348 |

*Primary Examiner*—Edgar S. Burr
*Assistant Examiner*—Ren Yan
*Attorney, Agent, or Firm*—Wood, Phillips, VanSanten, Hoffman & Ertel

[57] ABSTRACT

A mechanism for axially oscillating a distribution roller in a printing, duplicating or like machine, in which a drive shaft extends generally coaxially of the distribution roller. The mechanism is operatively associated between the drive shaft and the roller and includes right hand and left hand threads axially spaced of the shaft. A teeter member extends axially of the shaft and is pivotally mounted intermediate its opposite ends on a pivot axis extending generally transverse to the shaft. The teeter member has portions for alternating engagement in the right hand and left hand threads for axially oscillating the distribution roller in response to rotation of the roller. The threads have risers to lift the teeter member out of a respective threads, and a detent device facilitates moving the teeter member into the respective opposite thread.

9 Claims, 1 Drawing Sheet

Fig. 1
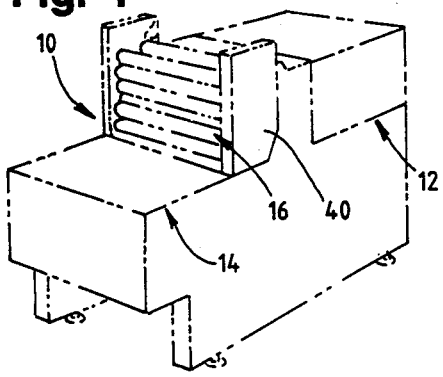
Fig. 2
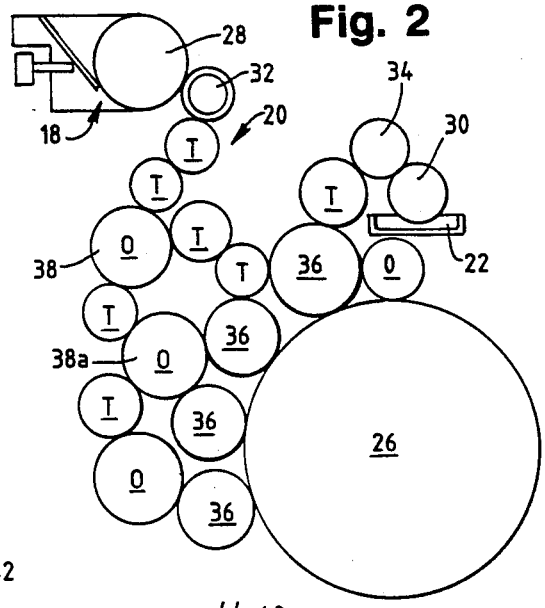
Fig. 3
PRIOR ART
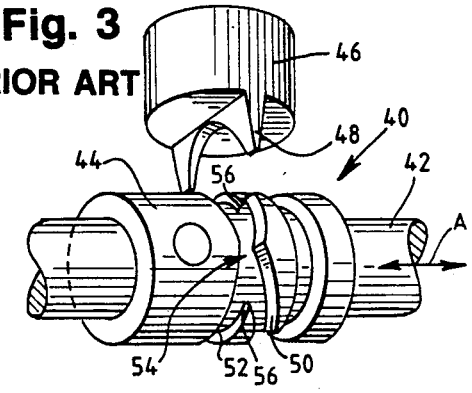
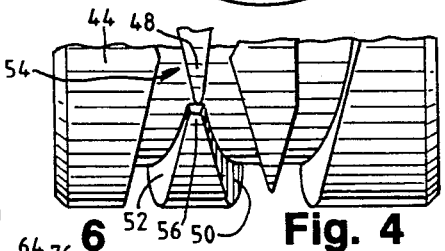
Fig. 4
PRIOR ART
Fig. 5
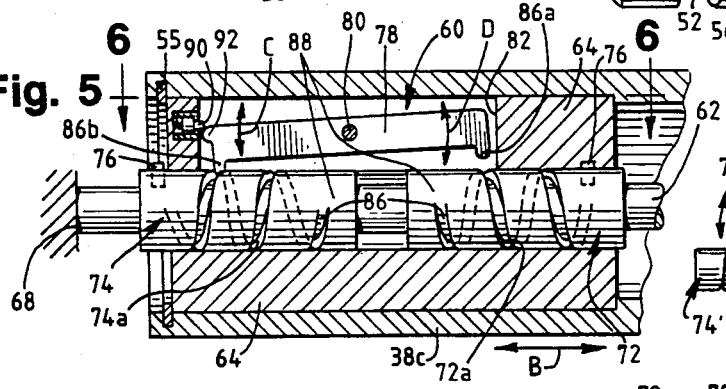
Fig. 8
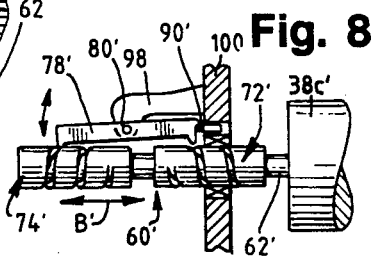
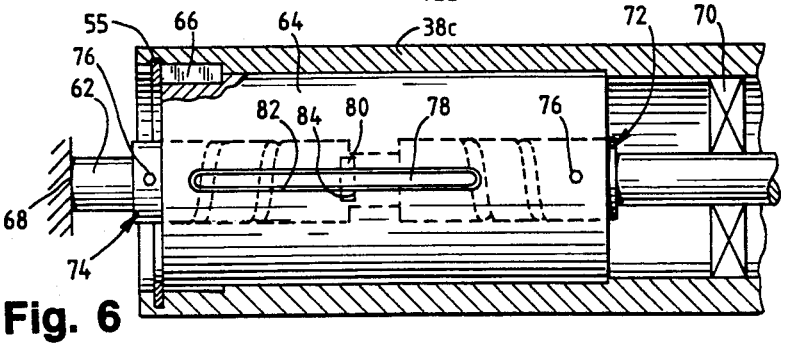
Fig. 6
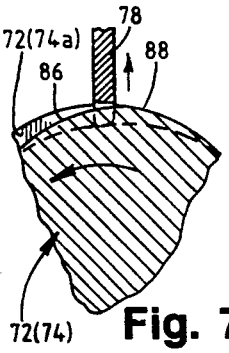
Fig. 7

OSCILLATING ROLLER MECHANISM FOR PRINTING OR DUPLICATING MACHINES

FIELD OF THE INVENTION

This invention generally relates to printing or duplicating machines and, more particularly, to a mechanism for oscillating a distribution roller in the printing couple of the machine.

BACKGROUND OF THE INVENTION

Printing machines normally include a printing couple which includes a number of cylinders and/or rollers such as impression cylinders, master cylinders, blanket cylinders, form rollers, ductor rollers, transfer rollers, regulator rollers, oscillating rollers, and the like. An ink fountain is disposed generally at the rear of the machine for feeding ink to the various rollers of the printing couple which transfers images to copy sheets. In such printing machines as rotary offset lithographic duplicating machines, a moisture fountain also is disposed adjacent the printing couple for feeding moisture to the printing couple. A number of rollers which generally can be termed "distribution" rollers are provided between the ink fountain and/or moisture fountain for distributing ink and/or moisture to the printing couple of the machine.

One type of distribution roller is an oscillating roller which is caused to oscillate axially across the surface of an adjacent roller or rollers to facilitate distributing and smoothing ink and/or moisture on the surface of the adjacent roller. Oscillating rollers may be located between a plurality of transfer rollers or may be located between the transfer rollers and one or more form rollers, the latter being provided to apply the ink and/or moisture to the surface of a master or plate cylinder.

Heretofore, a common type of roller oscillating mechanism has been a "reverse screw" mechanism in which an externally threaded member, such as a sleeve, is fixed to an end shaft of the oscillating roller. The sleeve has an external reverse thread system which, in essence, is formed by superimposing a right hand thread and a left hand thread onto each other and spanning the same axial distance of the sleeve. In other words, a right hand thread and a left hand thread are "interleaved" with each other. A fixed thread follower is mounted on the machine and projects into the interleave threads. As the oscillating roller rotates, the interengagement between the fixed follower and the interleaved reversed threads cause the oscillating roller to oscillate back and forth axially in response to rotation of the roller.

There have been problems in using reverse interleaved threads as described above. Particularly, a juncture must be provided in the thread arrangement generally at a mid-point intermediate the ends of the thread "stroke". The fixed thread follower has a tendency to hang-up or bind at this juncture. Attempts to solve this problem have only created additional problems. In particular, attempts have been made to form the thread juncture with very pointed "apexes" and to form the thread follower as a pointed member. Therefore, the points have less of a tendency to hang-up and bind or jam the mechanism. However, the apexes or points of the interengaging components have a tendency to break and create worse jamming problems than if the apexes were more smooth. In addition, the components of such mechanisms are fabricated of metal material, and broken pieces literally can tear into the respective components. As a result, repair and replacement of such interleaved reversed thread mechanisms has become a common item in servicing the overall machine, because such threaded mechanisms otherwise are efficient oscillating roller drive systems.

This invention is directed to solving the above problems while still affording the efficiency advantages of a reverse-thread-type oscillating roller mechanism.

SUMMARY OF THE INVENTION

An object, therefore, of the invention is to provide a new and improved mechanism for axially oscillating a distribution roller in a printing or duplicating machine.

In the exemplary embodiment of the invention, the oscillating mechanism is illustrated in a printing, duplicating or like machine which includes moisture and/or ink systems having a plurality of distribution rollers for distributing moisture and/or ink to the printing couple of the machine. Generally, shaft means extend axially from one end of one of the distribution rollers. Right hand and left hand thread means are axially spaced on the shaft means. Actuator means are provided for alternating engagement in the right hand and left hand thread means for axially oscillating the distribution roller in response to rotation of the roller. Means are provided for moving the actuator means alternatingly into the right hand and left hand thread means. By axially spacing the right hand and left hand thread means, all of the problems of interleaved reversed threads of the prior art are eliminated.

As disclosed herein, the actuator means are provided in the form of a teeter member extending axially of the shaft means and pivotally mounted intermediate opposite ends thereof on an axis extending generally transverse to the shaft means. The teeter member has thread engaging projections at its opposite ends.

Means are provided for temporarily holding the teeter member in either of two positions of engagement by its projections with either the right hand or left hand thread means. The holding means are provided in the form of complementary interengaging detent means operatively associated between the teeter member and a member positionally fixed relative to the teeter member. The detent means include a spring loaded detent member and a detent engaging portion of the teeter member positioned to snap back and forth over the spring loaded detent member to define the two positions of engagement of the teeter member with the right hand and left hand thread means.

Means are provided for moving the teeter member out of engagement with the right hand and left hand thread means automatically when the teeter member reaches a predetermined point in each thread means. In the preferred embodiment, this means is very simply provided by riser means in each thread means to lift the teeter member out of the respective thread means. The riser means is defined by the bottoms of each thread means gradually rising to the tops or peripheries of the thread means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a schematic perspective view of a printing or duplicating machine in which the invention is applicable;

FIG. 2 is a schematic view of the rollers comprising the system for feeding ink and moisture to a master cylinder of the machine;

FIG. 3 is an exploded perspective view of an interleaved reverse thread mechanism for an oscillating roller of the prior art;

FIG. 4 is a fragmented elevational view similar to that of FIG. 3, with the follower of the mechanism shown in a jammed position;

FIG. 5 is an axial section through one of the oscillating rollers shown in FIG. 2, and illustrated in elevation one form of oscillating roller mechanism of the invention;

FIG. 6 is a view similar to that of FIG. 5, taken generally in the direction of line 6—6 of FIG. 5;

FIG. 7 is a fragmented axial section, on an enlarged scale, showing how the bottom of a thread means lifts the teeter member out of the thread means; and FIG. 8 is an elevational view, on a reduced scale, of an alternate form of the invention.

DETAILED DESCRIPTION OF THE PREFERRED EMBODIMENT

Referring to the drawings in greater detail, and first to FIG. 1, the invention is illustrated herein for use in a printing, duplicating or like machine, generally designated 10, which includes a sheet feeding end, generally designated 12, and an imaged copy exiting end, generally designated 14. The copy sheets which have images produced on one or both sides are stacked at exiting end 14 as is conventional with most printing or duplicating machines. The machine includes at least one printing couple located in an area of the machine, generally designated 16. The printing couple includes the conventional impression cylinders, blanket cylinders and master or plate cylinders. Usually, the printing couple includes one impression cylinder, one blanket cylinder and one master or plate cylinder.

Printing or duplicating machine 10 may be such as a rotary offset lithographic machine which includes an ink fountain for feeding ink to various distribution rollers of the printing couple which transfers images to copy sheets. In addition, a moisture fountain is disposed adjacent the printing couple for feeding moisture to the printing couple through a path defined by the distribution rollers More particularly, FIG. 2 illustrates the ink/moisture roller system of the machine for distributing ink from an ink fountain, generally designated 18, through an ink feeding roller system, generally designated 20, and for feeding moisture from a moisture fountain 22 through a moisture feeding roller system, generally designated 24, to a master or plate cylinder 26. An ink fountain roller 28 is rotatable in ink fountain 18 and a moisture fountain roller 30 is rotatable in moisture fountain 22. Pickup rollers 32 and 34 are provided in rolling contact with ink fountain roller 28 and moisture fountain roller 30, respectively.

The ink/moisture distribution system includes four form rollers 36 in rolling contact with master cylinder 26. A number of transfer rollers and oscillating rollers are provided in the distribution system and, for brevity purposes, have been designated "T" and "O", respectively. Oscillating rollers "O" are provided with mechanisms for oscillating the rollers axially to facilitate distributing and smoothing the ink or moisture along the surfaces of adjacent rollers. For instance, referring to FIG. 2, the oscillating roller designated 38 is disposed between three adjacent transfer rollers. Therefore, the one oscillating roller 38 is effective to smooth the ink from fountain 18 and fountain roller 28 between three different transfer rollers. The oscillating roller designated 38*a* can be seen located between two transfer rollers and two form rollers 36 for similarly distributing and smoothing the ink over the surfaces of those rollers.

FIGS. 3 and 4 show a mechanism, generally designated 40, for axially oscillating a roller (not shown) similar to oscillating rollers 38, 38*a* (FIG. 2). The roller includes shaft means 42 extending axially of the roller. Oscillating mechanism 40 includes a reverse threaded member 44 and a thread follower member 46. The reverse threaded member is appropriately mounted for rotation with the roller and shaft means 42. Thread follower member 46 is appropriately fixed and has a thread follower portion 48 which projects into the threads of reverse threaded member 44.

More particularly, as is known in the art, reverse threaded member 44 has a right hand thread 50 and left hand thread 52 which are superimposed onto each other in sort of a reverse interleaved fashion. As the roller and shaft means 42 and reverse threaded member 44 rotate, thread follower portion 48 of thread follower member 46 rides in the interleaved right hand and left hand threads in a to-and-fro manner in the direction of double-headed arrow "A". Since cam follower member 46 is fixed, the roller is oscillated axially in the direction of arrow "A".

The problems with prior art reverse thread systems as illustrated in FIGS. 3 and 4 and as described in the Background, above, centers around the mid-point junctures of the right and left hand threads, as indicated generally in area 54. This is where the reverse threads intersect and form sort of "dead-end" portions 56 of the material of which threaded member 46 is fabricated. If portions 56 are very abrupt, or even rounded, there is a tendency for thread follower portion 48 of thread follower member 46 to bind or jam on portions 56. Consequently, heretofore, portions 56 and thread follower portion 48 are made quite pointed as illustrated in FIG. 3. The points or "apexes" of these portions are provided so that the pointed configurations of the respective components are insufficient to create a stop surface which might cause binding or jamming of the mechanism. However, such pointed portions of the mechanism create other problems in that they are very prone to breakage. FIG. 4 exemplifies a thread intersection or apex 56 which has become worn or broken. Once broken, abrupt edges are formed which are more prone to jamming than if the areas rounded were rounded in the first instance. FIG. 4 shows how follower 48 can jam-up on apex 56. In addition, since members 44 and 46 conventionally are fabricated of metal material, broken pieces can damage other components of the printing or duplicating machine.

This invention is directed to solving these problems, and one form or embodiment of the invention is shown in FIGS. 5–7. More particularly, referring to FIGS. 5 and 6, an oscillating mechanism, generally designated 60, is designed for axially oscillating a roller 38c similar to oscillating rollers 38, 38a described in relation to FIG. 2. The roller includes appropriate shaft means, as indicated by shaft 62 which extends axially of and concentrically with the roller. A sleeve 64 is axially and rotatably secured within roller 38c by any appropriate means such as a lock ring 55 and a key 56 (FIG. 6). The lock ring fixes the sleeve axially of the roller, and the key fixes the sleeve rotationally with the roller. Shaft 62 is fixedly mounted on the machine, as at 68, and roller 38c is journalled for rotation about the shaft, as by appropriate bearing means 70 (FIG. 6). Therefore, sleeve 64 rotates with the roller about shaft 62.

The invention contemplates that a right hand thread means, generally designated 72, and a left hand thread means, generally designated 74, be provided axially spaced on shaft 62. The right hand and left hand thread means are fixed to the shaft by any appropriate means, such as set screws 76. It should be understood that the terms "right hand" and "left hand" are used herein and in the claims hereof as conventional terms of art, it being understood that "right" and "left" are relative only, depending on the direction of viewing the threads. The basic principle is that the threads are in opposite directions. Therefore, thread means 72 and 74 have oppositely oriented threads 72a and 74a, respectively, axially spaced of shaft 62 and roller 38c.

Generally, actuator means are provided for alternating engagement in the right hand and left hand thread means for axially oscillating shaft 62 and roller 38c in response to rotation of the roller as it engages other rollers in the system of FIG. 2. More particularly, the actuator means include a teeter member 78 extending axially of shaft 62 and threads 72a and 74a, with the teeter member being pivotally mounted intermediate opposite ends thereof on a pivot axis defined by a pin 80 extending generally transverse to shaft 62. The teeter member is elongated and is disposed in an elongated slot 82 in sleeve 64. As best seen in FIG. 6, pin 80 extends into holes 84 in sleeve 64 on opposite sides of slot 82 in such a manner that teeter member 78 is free to oscillate or teeter about the axis defined by pin 80. The teeter member has a pair of thread engaging projections 86a and 86b for positioning in either right hand thread 72a or left hand thread 74a, respectively. Therefore, at this point, it can be understood that, since the threads 72a and 74a are cut in opposite directions, shaft 62 and oscillating roller 38c will move in either opposite axial direction, as indicated by double-headed arrow "B", depending on which thread either projection 86a or 86b is in engagement with.

Means are provided for moving teeter member 78 out of engagement with either the right hand or left hand thread 72a or 74a, respectively, when the respective projection 86a or 86b reaches a predetermined point in the respective thread. More particularly, referring to FIG. 7 in conjunction with FIG. 5, the predetermined points in the threads are the inner points, as indicated at 86 (FIG. 5). Whenever either projection 86a in thread 72a or projection 86b in thread 74a reaches the respective point 86, the teeter member will be lifted out of the thread. This lifting movement is effected by riser means formed by the bottoms of the threads rising toward the peripheral surfaces (areas indicated at 88) of threaded members 72. The location of axis 80 and the lengths of projections 86a and 86b are designed such that when one of the projections is lifted out of one of the respective threads, the other projection moves into the opposite thread.

To this end, means are provided for temporarily holding the teeter member in either of the two positions of engagement of either projections 86a or 86b with either the right hand or left hand threads 72a or 74a, respectively. Generally, the holding means is provided in the form of complementary interengaging detent means operatively associated between the teeter member and a fixed member. Specifically, the detent means is provided in the form of a spring loaded detent ball 90 (FIG. 5) fixed to sleeve 64 which, in turn, is fixed to roller 38c. A detent engaging member is provided in the form of a projection 92 which projects away from one axial end of teeter member 78. It can be seen that spring loaded ball 90 is in the path of movement of detent projection 92, as indicated by double-headed arrow "C". Effectively, spring loaded detent ball 90 and detent projection 92 provide a type of "over-center" holding means which not only holds the teeter member in its two positions of engagement by projections 86a, 86b with their respective threads, but the detent arrangement facilitates "snapping" the teeter member over-center to positively move the respective projection into its respective thread. Otherwise, the teeter member might have an intermediate or momentary equilibrium position whereby neither projection 86a nor 86b is in either of the opposite threads.

In operation, as roller 38c rotates by engagement with other rollers in the system described in relation to FIG. 2, sleeve 64, teeter member 78 and detent means 90, 92 all rotate with the roller. During rotation, one of the projections 86a or 86b on teeter member 78 will be in engagement with one of the opposite threads 72a or 74a, respectively, causing the roller to move axially in one direction. When the respective projection reaches the respective point 86 of its respective thread, the projection and, in turn, the teeter member will be lifted out of the respective thread, and, at the same time, detent projection 92 will snap over-center spring loaded detent ball 90 whereupon the opposite projection will be snapped into the opposite end of the other thread to axially move the roller in the opposite axial direction. As the roller continues to rotate, teeter member 78 continues to oscillate about axis 80, as indicated by double-headed arrow "D" (FIG. 5) and projections 86a and 86b alternatingly snap into reverse threads 72a and 74a, respectively, to continuously oscillate the roller in the direction of double-headed arrow "B".

FIG. 8 shows an alternate form of the invention, and primed reference numerals are applied to indicate like components described in relation to FIGS. 5–7. Basically, in this form of the invention, opposite thread means 72 and 74 again are fixed on shaft 62'. However, the shaft is fixed for rotation with roller 38a'. Therefore, oscillating mechanism 60', including teeter member 78', is fixed, as by mounting the teeter member on an arm 98 projecting outwardly from a frame portion 100 of the machine. Again, the teeter member pivots about an axis 80' extending transverse to shaft 62', and an over-center spring loaded detent 90' is fixed to frame portion 100. Otherwise, the mechanism 60' shown in FIG. 8 is effective to oscillate roller 38c' similar to mechanism 60 described above in relation to FIGS. 5–7.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a printing, duplicating or like machine which includes a moisture or ink system having a plurality of distribution rollers for distributing moisture or ink to the printing couple of the machine, a mechanism for axially oscillating one of the distribution rollers relative to a fixed member on the machine comprising:

shaft means extending axially of said one distribution roller;

right hand and left hand thread means axially spaced on the shaft means;

actuator means for alternating engagement in the right hand and left hand thread means for axially oscillating the distribution roller in response to rotation of the roller;

means for moving the actuator means alternatingly into and out of the right hand and left hand thread means; and a single means for temporarily holding the actuator means in either of two positions of engagement with either the right hand or left hand thread means including complementary interengaging detent means operatively associated between the actuator means and the fixed member and having a spring loaded detent member on one of the actuator means and fixed member and a detent engaging projection on the other of the actuator means and fixed member whereby the detent engaging member can snap back and forth over the spring loaded detent member to define said positions, wherein said actuator means comprises a pivotable teeter member with spaced ends, further wherein said single holding means comprises one of the spring loaded detent member and detent engaging projection on the fixed member and the other of the spring loaded detent member and detent engaging projection on one end of the teeter member.

2. The mechanism of claim 1 wherein said teeter member extends axially of the shaft means and is pivotably mounted intermediate opposite ends thereon on a pivot axis extending generally transverse to the shaft means.

3. The mechanism of claim 2 wherein said teeter member has thread engaging projections at its opposite ends.

4. The mechanism of claim 1, including means for moving the actuator means out of engagement with the right hand and left hand thread means automatically when the actuator means reaches a predetermined point in each thread means.

5. The mechanism of claim 4 wherein said means for moving the actuator means comprise riser means in each thread means to lift the actuator means out of the respective thread means.

6. The mechanism of claim 5 wherein said riser means are defined by the bottoms of each thread means.

7. In a printing, duplicating or like machine which includes a moisture or ink system having a plurality of distribution rollers for distributing moisture or ink to the printing couple of the machine, a mechanism for axially oscillating one of the distribution rollers relative to a fixed member on the machine, said oscillating mechanism comprising:

shaft means extending axially of said one distribution roller;

right hand and left hand thread means axially spaced on the shaft means;

a teeter means for alternating engagement in the right hand and left hand thread means for axially oscillating the distribution roller in response to rotation of the roller, the teeter member extending axially of the shaft means and being pivotally mounted intermediate opposite ends thereof on a pivot axis extending generally transverse to the shaft means, said tester member having a detenting projection projecting from one end thereof;

riser means defined by the bottoms of each thread means for moving the teeter member automatically into one of the right and left hand thread means and out of the other right hand and left hand thread means when the teeter member reaches a predetermined point in one of the respective thread means; and a single spring biased means for releasably engaging said detenting projection and holding the teeter member in engagement with either the right hand or the left hand thread means.

8. The mechanism of claim 7 wherein said teeter member has thread engaging projections at its opposite ends.

9. The mechanism of claim 7 wherein said bottoms of each thread means rise toward said predetermined points on peripheral surfaces of each of the respective thread means.

* * * * *